US010696064B2

(12) United States Patent
Vella

(10) Patent No.: US 10,696,064 B2
(45) **Date of Patent: *Jun. 30, 2020**

(54) DIGITAL PRINTING MACHINE AND METHOD

(71) Applicant: Stolle Machinery Company, LLC, Centennial, CO (US)

(72) Inventor: Anthony J. Vella, Aurora, CO (US)

(73) Assignee: Stolle Machinery Company, LLC, Centennial, CO (US)

( * ) Notice: Subject to any disclaimer, the term of this patent is extended or adjusted under 35 U.S.C. 154(b) by 130 days.

This patent is subject to a terminal disclaimer.

(21) Appl. No.: 15/372,459

(22) Filed: Dec. 8, 2016

(65) Prior Publication Data

US 2017/0087872 A1 Mar. 30, 2017

Related U.S. Application Data

(63) Continuation of application No. 15/064,671, filed on Mar. 9, 2016, now Pat. No. 9,550,372, which is a (Continued)

(51) Int. Cl.

| | |
|---|---|
| ***B41J 17/18*** | (2006.01) |
| ***B41J 17/28*** | (2006.01) |
| ***B41J 3/407*** | (2006.01) |
| ***B41J 11/00*** | (2006.01) |
| ***B41F 17/00*** | (2006.01) |
| ***B41F 17/18*** | (2006.01) |

(Continued)

(52) U.S. Cl.

CPC ..... *B41J 3/4073* (2013.01); *B41F 17/002* (2013.01); *B41F 17/006* (2013.01); *B41F 17/18* (2013.01); *B41F 17/28* (2013.01); *B41F 17/30* (2013.01); *B41J 11/002* (2013.01)

(58) Field of Classification Search

CPC ..... B41F 17/14; B41F 17/18; B41F 17/20; B41F 17/22; B41F 17/28; B41F 17/30; B41F 17/002; B41F 17/06; B41F 17/006; B41J 3/4073; B41M 1/0041

See application file for complete search history.

(56) References Cited

U.S. PATENT DOCUMENTS

| | | | |
|---|---|---|---|
| 3,645,201 A | 2/1972 | Jackson | |
| 4,543,883 A | 10/1985 | Skrypek et al. | |

(Continued)

FOREIGN PATENT DOCUMENTS

| | | | | |
|---|---|---|---|---|
| DE | 4424528 | * | 1/1996 | ..... B41J 2/005 |
| EP | 2703305 | | 5/2014 | |

(Continued)

OTHER PUBLICATIONS

Stolle Machinery Company, LLC, EP Pat. No. 15884157.7, Extended European Search Report, dated Sep. 3, 2018, 9 pages.

(Continued)

*Primary Examiner* — Matthew G Marini
*Assistant Examiner* — Marissa Ferguson-Samreth
(74) *Attorney, Agent, or Firm* — Eckert Seamans Cherin & Mellott, LLC

(57) ABSTRACT

A decorator assembly is provided. The decorator assembly includes a number of independent ink stations. Each independent ink station is disposed adjacent to the path of travel of the mandrels.

10 Claims, 14 Drawing Sheets

Related U.S. Application Data continuation of application No. 14/880,467, filed on Oct. 12, 2015, now Pat. No. 9,327,493.

(60) Provisional application No. 62/127,910, filed on Mar. 4, 2015.

(51) Int. Cl.
*B41F 17/28* (2006.01)
*B41F 17/30* (2006.01)

(56) References Cited

U.S. PATENT DOCUMENTS

| | | | | |
|---|---|---|---|---|
| 5,337,659 | A | 8/1994 | Whelan | |
| 5,970,865 | A | 10/1999 | Horth et al. | |
| 6,337,487 | B1 | 1/2002 | Dubuit et al. | |
| 6,769,357 | B1 | 8/2004 | Finan | |
| 7,261,033 | B2 * | 8/2007 | Dubuit | B41F 15/0872 101/116 |
| 9,132,664 | B2 | 9/2015 | Schach | |
| 2005/0046648 | A1 | 3/2005 | Dumenil | |
| 2009/0020024 | A1 | 1/2009 | Campioli et al. | |
| 2010/0313771 | A1 | 12/2010 | Ferrari et al. | |
| 2011/0232514 | A1 | 9/2011 | Putzer et al. | |
| 2011/0285768 | A1 | 11/2011 | Preckel | |
| 2012/0188299 | A1 | 7/2012 | Seki et al. | |
| 2014/0028771 | A1 * | 1/2014 | Yamada | B41J 2/0057 347/104 |
| 2015/0033965 | A1 * | 2/2015 | Knott | B41F 17/00 101/36 |
| 2015/0059600 | A1 * | 3/2015 | Heidrich | B41F 17/28 101/36 |
| 2016/0101631 | A1 * | 4/2016 | Dumenil et al. | B41J 3/4073 347/16 |

FOREIGN PATENT DOCUMENTS

| | | | | |
|---|---|---|---|---|
| GB | 2023500 | * | 1/1980 | B41F 17/22 |
| JP | 2015-039676 | | 3/2015 | |
| JP | 2015039676 | * | 3/2015 | B41J 3/4073 |
| WO | 2010122014 | | 10/2010 | |
| WO | 2014076704 A1 | | 5/2014 | |

OTHER PUBLICATIONS

Stolle Machinery Company, LLC, JP 2017-546243 Office Action, dated Mar. 3, 2020, 6 pages.

* cited by examiner

DIGITAL PRINTING MACHINE AND METHOD

CROSS REFERENCE TO RELATED APPLICATION

This application is a continuation patent application and claims priority to U.S. patent application Ser. No. 15/064,671, filed Mar. 9, 2016, which application is a continuation patent application and claims priority to U.S. patent application Ser. No. 14/880,467, filed Oct. 12, 2015, now issued U.S. Pat. No. 9,327,493, issued May 3, 2016, which application claims priority to U.S. Provisional Patent Application Ser. No. 62/127,910, filed Mar. 4, 2015, entitled "Digital Printing Machine and Method."

BACKGROUND OF THE INVENTION

Field of the Invention

The disclosed concept relates generally to machinery and, more particularly, to can decorator machines for decorating cans used in the food and beverage packaging industries. The disclosed concept also relates to ink station assemblies for can decorator machines.

Background Information

High speed continuous motion machines for decorating cans, commonly referred to as can decorator machines or simply can decorators, are generally well known. A typical can decorator is disclosed in commonly assigned U.S. Pat. No. 5,337,659. The can decorator includes an in-feed conveyor, which receives cans from a can supply (not shown) and directs them to arcuate cradles or pockets along the periphery of spaced parallel rings secured to a pocket wheel. The pocket wheel is fixedly secured to a continuously rotating mandrel carrier wheel or turret. The turret, in turn, is keyed to a continuously rotating horizontal drive shaft. Radial/horizontal spindles or mandrels, each being rotatable about its own axis, are mounted to the mandrel carrier wheel adjacent its periphery. Downstream from the in-feed conveyor, each mandrel is in closely spaced axial alignment with an individual pocket and undecorated cans are transferred from the pockets to the mandrels. Suction applied through an axial passage of the mandrel draws the can to a final seated position on the mandrel.

While mounted on, and rotating with, the mandrels, the cans are decorated by being brought into engagement with a blanket (e.g., without limitation, a replaceable adhesive-backed piece of rubber) that is adhered to a blanket segment of a multicolor printing unit. Thereafter, and while still mounted on the mandrels, the outside of each decorated can is coated with a protective film of varnish applied by engagement with the periphery of an application roll in an over-varnish unit. Cans with decorations and protective coatings thereon are then transferred from the can decorator for further processing.

Application of ink to the can is accomplished as follows. Prior to engagement with an undecorated can, the blanket engages a plurality of printing cylinders, each of which is associated with an individual ink station assembly. That is, each ink station is one of a plurality of printing stations. An ink station assembly includes an ink fountain and a plurality of rolls, typically about ten rolls. The next to final roll is a printing cylinder. The printing cylinder applies the ink to the blanket which, in turn, applies the ink to a can. Each ink station assembly provides a different color ink and each printing cylinder applies a different image segment to the blanket. All of these image segments combine to produce the main image. This main image is then transferred to undecorated cans.

This configuration has several disadvantages. For example, to maintain the mandrels spinning at a speed corresponding to the speed of ink stations, a complex system of gears, and other motion transmission elements, couples the mandrels to the turret and ink stations. Each element of such a system is subject to wear and tear. Further, all linked elements of the system rotate at the same time. Thus, for example, the various rolls of the print stations rotate when the turret rotates, even if no cans are being decorated, e.g., during initialization of the system.

Further, in this configuration, the horizontally extending drive shaft of the turret is subjected to a moment arm due to the weight of the turret and mandrels. This moment arm is not desirable as the force causes additional wear and tear. Also, the linked elements of the drive assemblies cause unneeded wear and tear on elements that are not in use at the same time. Additionally, the mechanical elements required for linked drive assemblies have a weight that must be supported. Thus, the decorator assembly housing assembly must be more robust. This is in contrast to other configurations, such as, but not limited to, a cantilever configuration for an ink station which is less massive than known designs. Further, the printing cylinder includes a fixed print image. As such, changing the image requires changing the printing cylinder, which is a time consuming process. As such, printed indicia, such as a sequential serial number cannot be printed by the printing cylinder. Also, print cylinders are typically disposed below the mandrel upon which a can being decorated is disposed. In this configuration, excess ink may be sprayed upward and outward in a broad pattern. There is, therefore, room for improvement in can decorating machines and ink station assemblies.

SUMMARY OF THE INVENTION

These needs, and others, are met by at least one embodiment of the disclosed and claimed concept which provides a decorator assembly including a mandrel turret assembly. The mandrel turret assembly includes a rotatable turret, a number of mandrels, and a number of independent ink stations. Each mandrel is rotatably coupled to the turret. Each mandrel extends generally radially from the turret and is disposed generally in a plane about an axis of rotation. The turret is structured to rotate about an axis of rotation thereby moving each mandrel over a generally circular path of travel. Each independent ink station is disposed adjacent to the path of travel of the mandrels.

It is noted that the configuration disclosed below solves the stated problems above. That is, for example, the use of independent ink station, i.e., ink stations that are not operatively mechanically coupled to the turret, solves the problem of a decorator assembly having an excessive number of drive assembly components. Further, the lack of ink stations operatively and mechanically coupled to the turret reduces the weight, moment arm, and other various stresses associated with prior turret assemblies. Thus, the reduction in weight of the turret assembly solves the problems stated above.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
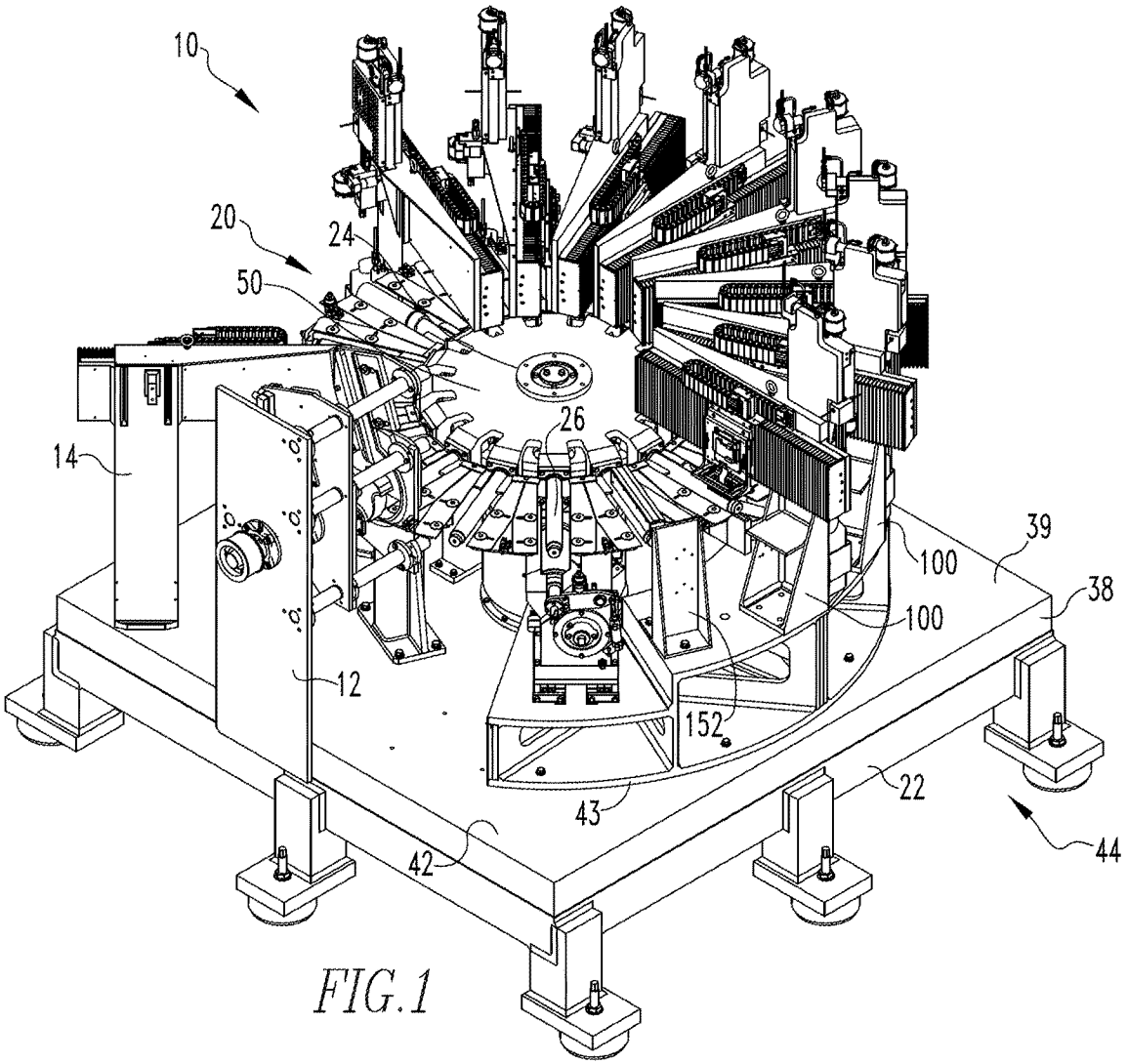
FIG. 1 is a first isometric view of a decorator assembly.

For purposes of illustration, embodiments of the disclosed concept will be described as applied to cans and/or can ends for beverage/beer cans, although it will become apparent that they could also be employed to other containers such as, for example and without limitation, cans for liquids other than beer and beverages, and food cans.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations and other physical characteristics related to the embodiments disclosed herein are not to be considered limiting on the scope of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As employed herein, the terms "can" and "container" are used substantially interchangeably to refer to any known or suitable container, which is structured to contain a substance (e.g., without limitation, liquid; food; any other suitable substance), and expressly includes, but is not limited to, food cans, as well as beverage cans, such as beer and soda cans.

As employed herein, the term "can end" refers to the lid or closure that is structured to be coupled to a can, in order to seal the can.

As used herein, the singular form of "a," "an," and "the" include plural references unless the context clearly dictates otherwise.

As used herein, a "coupling assembly" includes two or more couplings or coupling components. The components of a coupling or coupling assembly are generally not part of the same element or other component. As such, the components of a "coupling assembly" may not be described at the same time in the following description.

As used herein, a "coupling" or "coupling component" is one element of a coupling assembly. That is, a coupling assembly includes at least two components, or coupling components, that are structured to be coupled together. It is understood that the elements of a coupling assembly are compatible with each other. For example, in a coupling assembly, if one coupling element is a snap socket, the other coupling element is a snap plug. A "coupling" or "coupling component" includes a passage through which another element, such as but not limited to, a fastener passes.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. It is noted that moving parts may be "directly coupled" when in one position, but may not be "directly coupled" when in another position. As used herein, "fixedly coupled" or "fixed" means that two components are coupled so as to move as one while maintaining a constant orientation relative to each other. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof.

As used herein, the phrase "removably coupled" means that one component is coupled with another component in an essentially temporary and selectable manner. That is, the two components are coupled in such a way that the joining or separation of the components is easy and would not damage the components. For example, two components secured to each other with a limited number of readily accessible coupling assemblies are "removably coupled" whereas two components that are welded together or joined by difficult to access fasteners are not "removably coupled." A "difficult to access coupling assembly" is one that requires the removal of one or more other components prior to accessing the coupling assembly wherein the "other component" is not an access device such as, but not limited to, a door. By way of a further example, a clutch in an automobile is selectively coupled to the engine and the transmission, but is not a "removable coupling" in that the clutch is encased in a housing and cannot easily be accessed. Further, to be "removably coupled," no coupling assemblies linking the two elements can be a "difficult to access coupling assembly." That is, two elements coupled by many easy to access couplings and a single "difficult to access" fastener are not "removably coupled."

As used herein, "operatively coupled" means that a number of elements or assemblies, each of which is movable between a first position and a second position, or a first configuration and a second configuration, are coupled so that as the first element moves from one position/configuration to the other, the second element moves between positions/configurations as well. It is noted that a first element may be "operatively coupled" to another without the opposite being true.

As used herein, the statement that two or more parts or components "engage" one another shall mean that the parts exert a force against one another either directly or through one or more intermediate parts or components.

As used herein, the word "unitary" means a component is created as a single piece or unit. That is, a component that includes pieces that are created separately and then coupled together as a unit is not a "unitary" component or body.

As used herein, "structured to [verb]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies. As such, as used herein, "structured to [verb]" recites structure and not function.

As used herein, the term "number" shall mean one or an integer greater than one (i.e., a plurality).

As used herein, a "fastener" is a separate component structured to couple two or more elements. Thus, for example, a bolt is a "fastener" but a tongue-and-groove coupling is not a "fastener." That is, the tongue-and-groove elements are part of the elements being coupled and are not a separate component.

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are to fit "snugly" together. In that situation, the difference between the size of the components is even smaller whereby the amount of friction increases. If the element defining the opening and/or the component inserted into the opening are made from a deformable or compressible material, the opening may even be slightly smaller than the component being inserted into the opening. With regard to surfaces, shapes, and lines, two, or more, "corresponding" surfaces, shapes, or lines have generally the same size, shape, and contours.

As used herein, a "computer" is a device structured to process data having at least one input device, e.g., a keyboard, mouse, or touch-screen, at least one output device, e.g., a display, a graphics card, a communication device, e.g., an Ethernet card or wireless communication device, permanent memory, e.g., a hard drive, temporary memory, i.e., random access memory, and a processor, e.g., a programmable logic circuit. The "computer" may be a traditional desktop unit but also includes cellular telephones, tablet computers, laptop computers, as well as other devices, such as gaming devices that have been adapted to include components such as, but not limited to, those identified above. Further, the "computer" may include components that are physically in different locations. For example, a desktop unit may utilize a remote hard drive for storage. Such physically separate elements are, as used herein, a "computer."

As used herein, the word "display" means a device structured to present a visible image. Further, as used herein, "present" means to create an image on a display which may be seen by a user.

As used herein, a "computer readable medium" includes, but is not limited to, hard drives, CDs, DVDs, magnetic tape, floppy drives, and random access memory.

As used herein, "permanent memory" means a computer readable storage medium and, more specifically, a computer readable storage medium structured to record information in a non-transitory manner. Thus, "permanent memory" is limited to non-transitory tangible media.

As used herein, "stored in the permanent memory" means that a module of executable code, or other data, has become functionally and structurally integrated into the storage medium.

As used herein, a "file" is an electronic storage construct for containing executable code that is processed, or, data that may be expressed as text, images, audio, video or any combination thereof.

As used herein, a "module" is an electronic construct used by a computer, or other processing assembly, and includes, but is not limited to, a computer file or a group of interacting computer files such as an executable code file and data storage files, used by a processor and stored on a computer readable medium. Modules may also include a number of other modules. It is understood that modules may be identified by their purpose of function. Unless noted otherwise, each "module" is stored in permanent memory of at least one computer or processing assembly. All modules are shown schematically in the Figures.

As used herein, "in electronic communication" is used in reference to communicating a signal via an electromagnetic wave or signal. "In electronic communication" includes both hardline and wireless forms of communication.

As used herein, "in electric communication" means that a current passes, or can pass, between the identified elements.

As used herein, an "independent ink station" means one of a number of spaced printing stations that apply an indicia to a common object, but wherein a mechanical drive mechanism, which causes the primary motion of the ink applicator, for the stations is not mechanically linked to other drive assemblies. For example, in a traditional turret printing assembly, the print stations share a mechanical drive and therefore are not "independent ink stations." Further, a "printing device" as used herein includes, but is not limited to, a common printer typically coupled to a home/office computer and/or the print head of a printer coupled to a home/office computer. A "printing device" cannot be an "independent ink station" (or an "independent printing device") because there is only a single printing device and, as such, the printing device is not "one of a number of spaced printing stations." Further, two separate printing devices coupled to a home/office computer are not "independent ink stations" because the printing devices do not apply an indicia to a common object. Further, a printing device including a number of adjacent print heads is not an "independent ink station" because the print heads are not spaced. That is, as used herein, "spaced" means a greater distance than the distance between adjacent print heads of a common ink jet printing device that includes adjacent print heads.

As used herein, a "print head drive assembly" is a drive assembly that drives a printing device during the application of an ink. A device structured to cause rotation of a printing device in between periods wherein an ink is applied is not a "print head drive assembly." For example, an air actuator structured to rotate an ink roll when an associated print roll is not in operation is not a "print head drive assembly."

Figure 2:
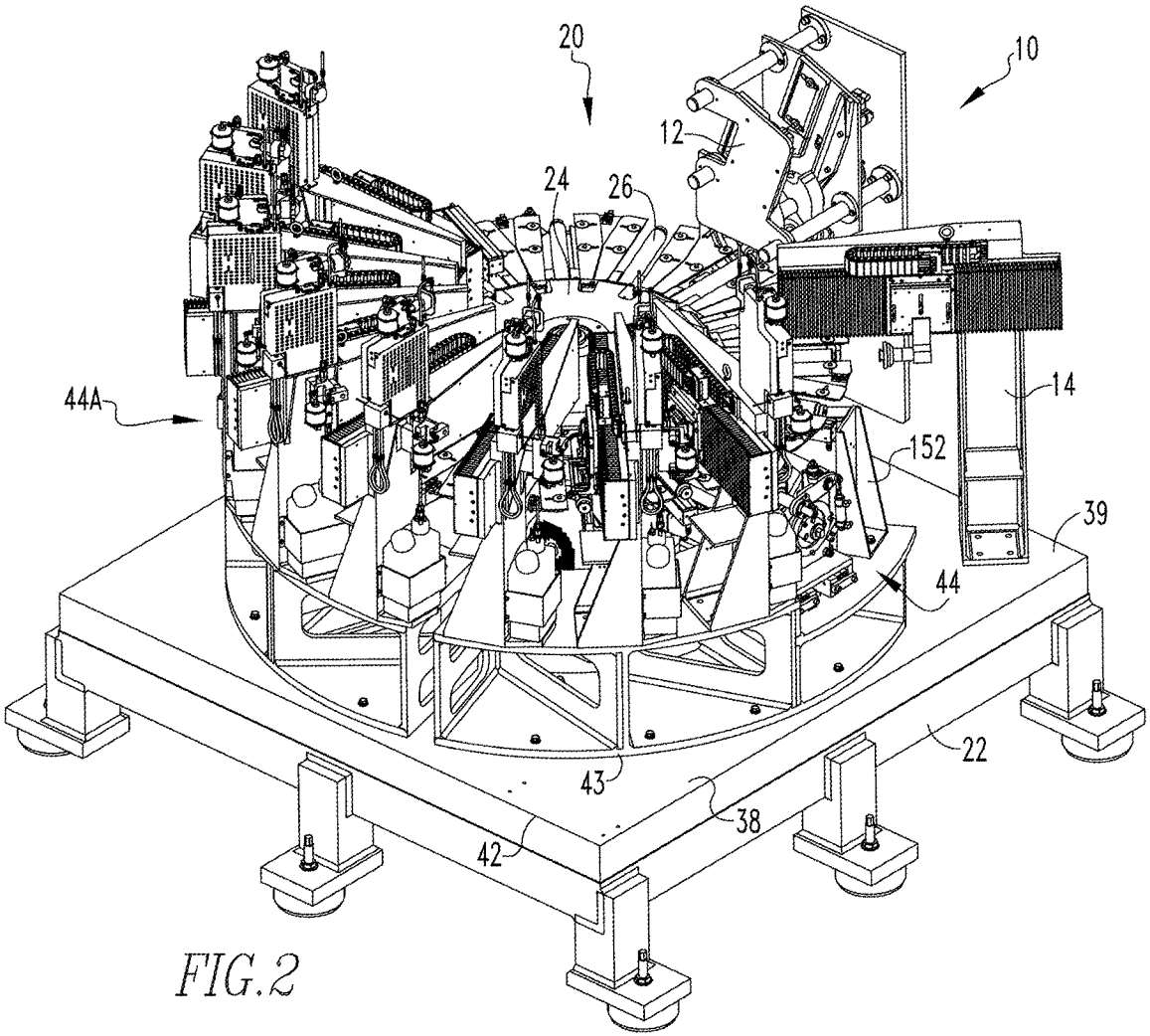
FIG. 2 is a second isometric view of a decorator assembly.
Figure 3:
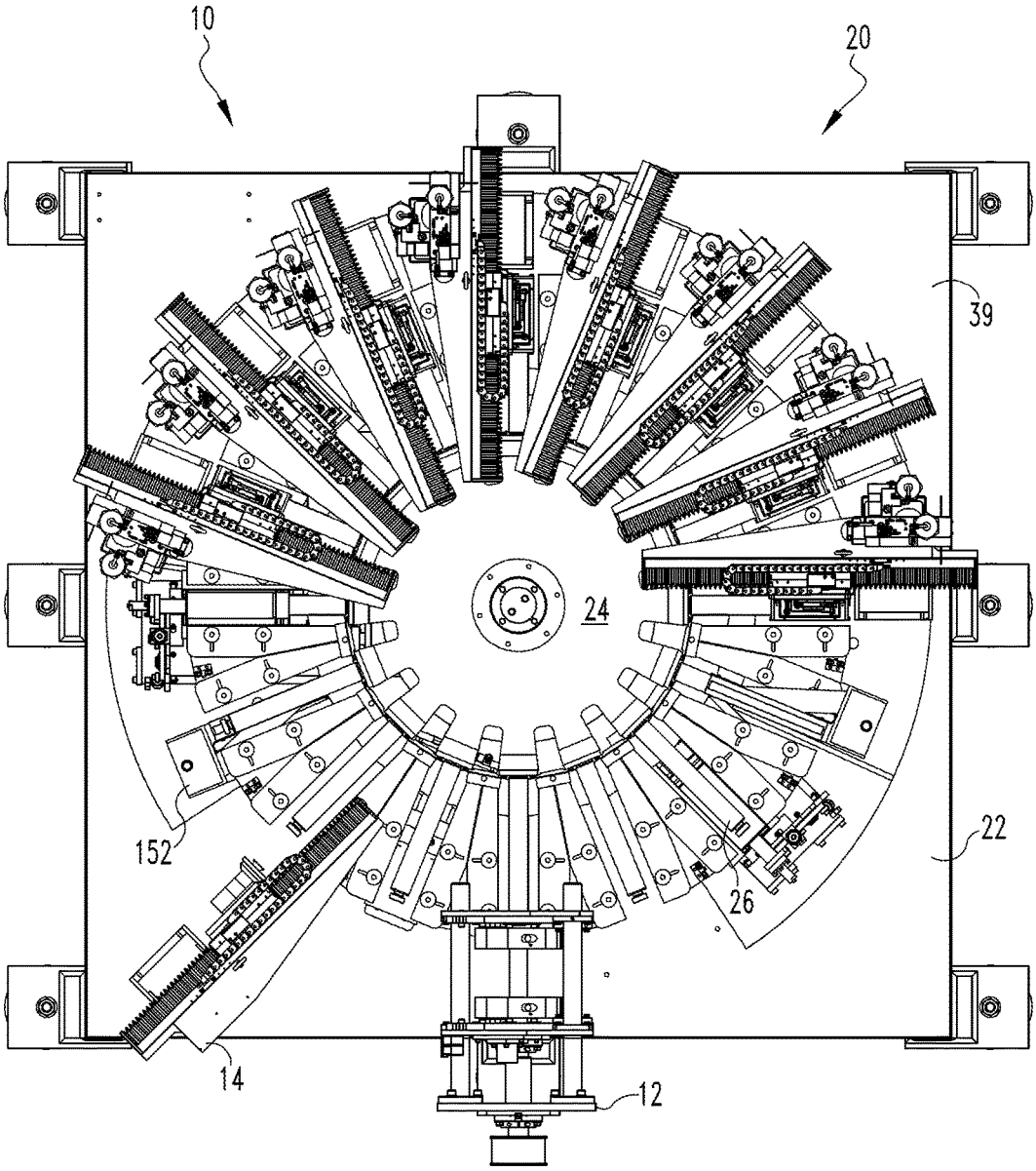
FIG. 3 is a top view of a decorator assembly.

A decorator assembly 10 is shown in FIGS. 1-3. The decorator assembly 10 includes an in-feed assembly 12, an ejection assembly 14, and a mandrel turret assembly 20, as well as other assemblies such as, but not limited to, an ink supply assembly (not shown). The mandrel turret assembly 20 includes a housing assembly 22, a rotatable turret 24, a number of mandrels 26, a turret drive assembly 28 (FIGS. 4-5), a mandrel drive assembly 30 (FIG. 5), a drive control assembly 32 (shown schematically in FIG. 4), a number of ink cure stations 34 and a number of independent ink stations 100. As is known, the in-feed assembly 12 is structured to supply a number of can bodies 1 (shown schematically in FIG. 5) and to position a can body 1 on a mandrel 26. Similarly, as is known, the ejection assembly 14 is structured to eject a can body 1 decorated with an indicia.

The mandrel turret assembly housing assembly 22 is structured to support a number of independent ink stations 100. As used herein, the "mandrel turret assembly housing assembly" 22 may include generally solid sidewalls defining an enclosed space, plate members, a generally open frame, or a combination thereof. In an exemplary embodiment, mandrel turret assembly housing assembly 22 includes a number of sidewalls 38 forming a deck 39. The deck 39 includes an upper surface 42. In an exemplary embodiment, shown in FIG. 6, the deck upper surface 42 further supports a frame assembly 43 that defines a plurality of "bays" 44 or, in an exemplary embodiment, "uniform bays" 44A.

Figure 4:
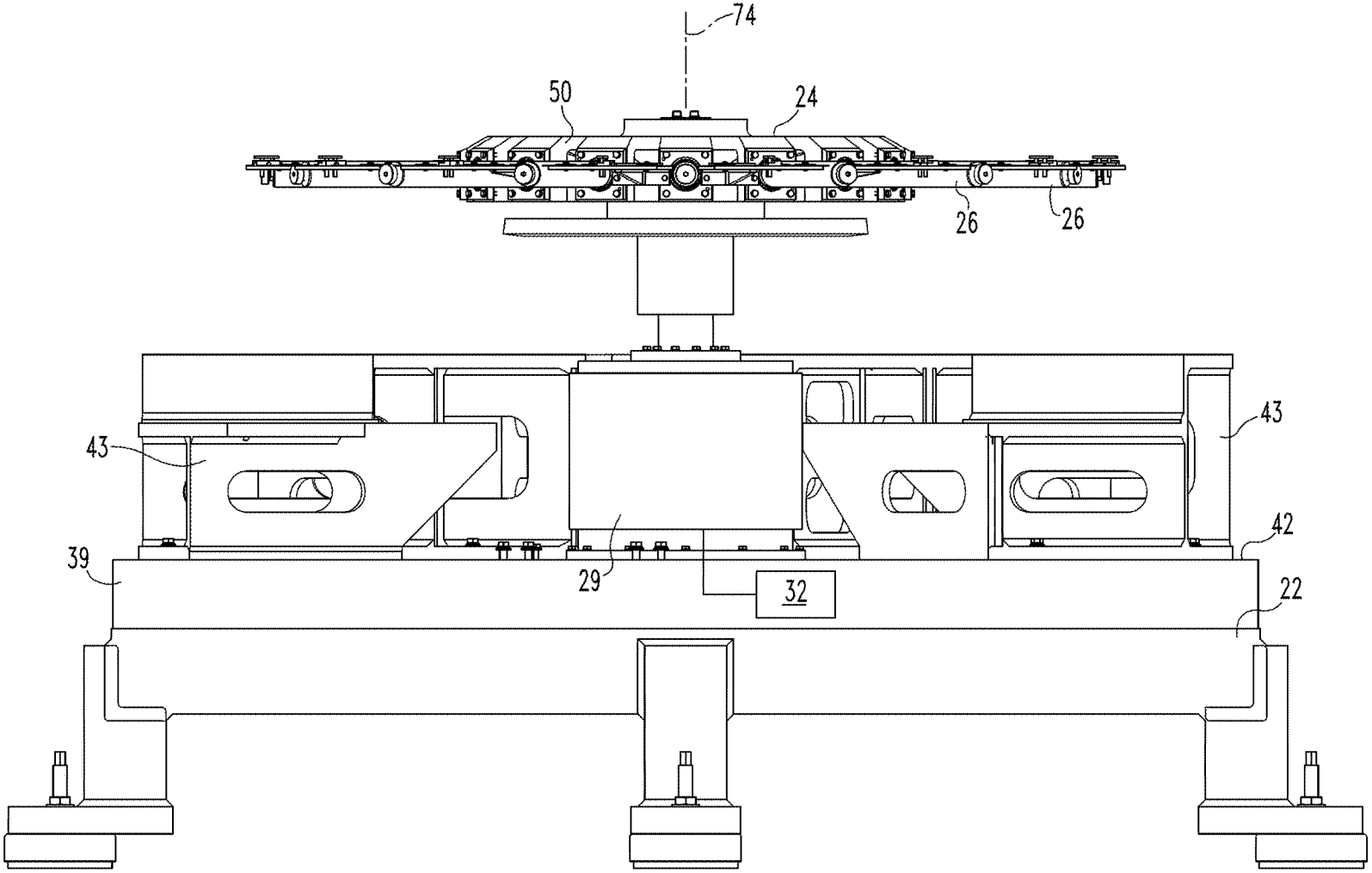
FIG. 4 is side view of a decorator assembly with the ink stations and other stations removed.

As used herein, a "bay" is a defined space on, or in, a housing assembly structured to have another element or assembly removably coupled thereto. A "bay" may be defined by a number of sidewalls (not shown) or, as shown, a number of coupling components. That is, in an exemplary embodiment, each bay 44 is defined by a set of passages 46 structured to act as a coupling passage. As used herein, a "uniform bay" means that a number of "bays" are substantially similar. Thus, in an exemplary embodiment, the passages 46 are "uniform passages" 46A. That is, the uniform passages 46A are disposed in a similar pattern, with passages of a like size disposed in a like position, within a uniform bay 44A. As discussed below, the turret drive assembly 28 defines a generally vertical axis of rotation 74 (FIG. 4). The uniform bays 44A are, in an exemplary embodiment, disposed generally circumferentially about, i.e., at least partially encircling, the turret drive assembly axis of rotation 74. Further, the uniform bays 44A are evenly spaced about, i.e., at least partially encircling, the turret drive assembly axis of rotation 74. Further, in an exemplary embodiment, the uniform bays 44A are disposed at the periphery of the mandrel turret assembly housing assembly upper surface 42. Thus, with the exception of the first and last bay 44 in the series, a bay 44 disposed in series has one bay 44, an adjacent upstream bay 44 and an adjacent downstream bay 44. As used herein, "upstream" and "downstream" refer to the circumferential direction of travel of the mandrels 26 about the turret axis of rotation 74. Thus, as described below, the mandrel 26 path of travel passes over a number of bays 44 disposed in series.

Figure 5:
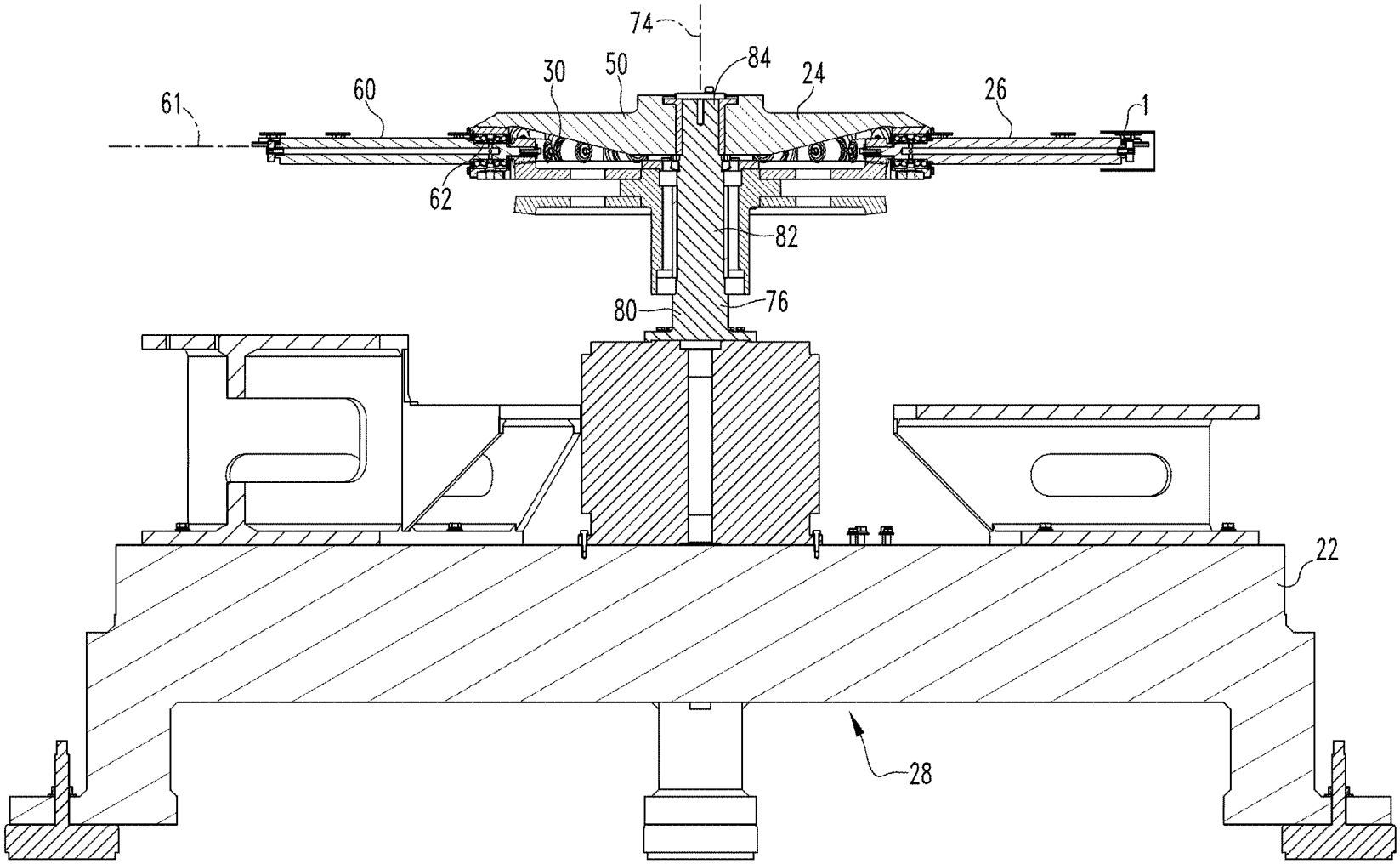
FIG. 5 is a cross-sectional view of a decorator assembly with the ink stations and other stations removed.
Figure 6:
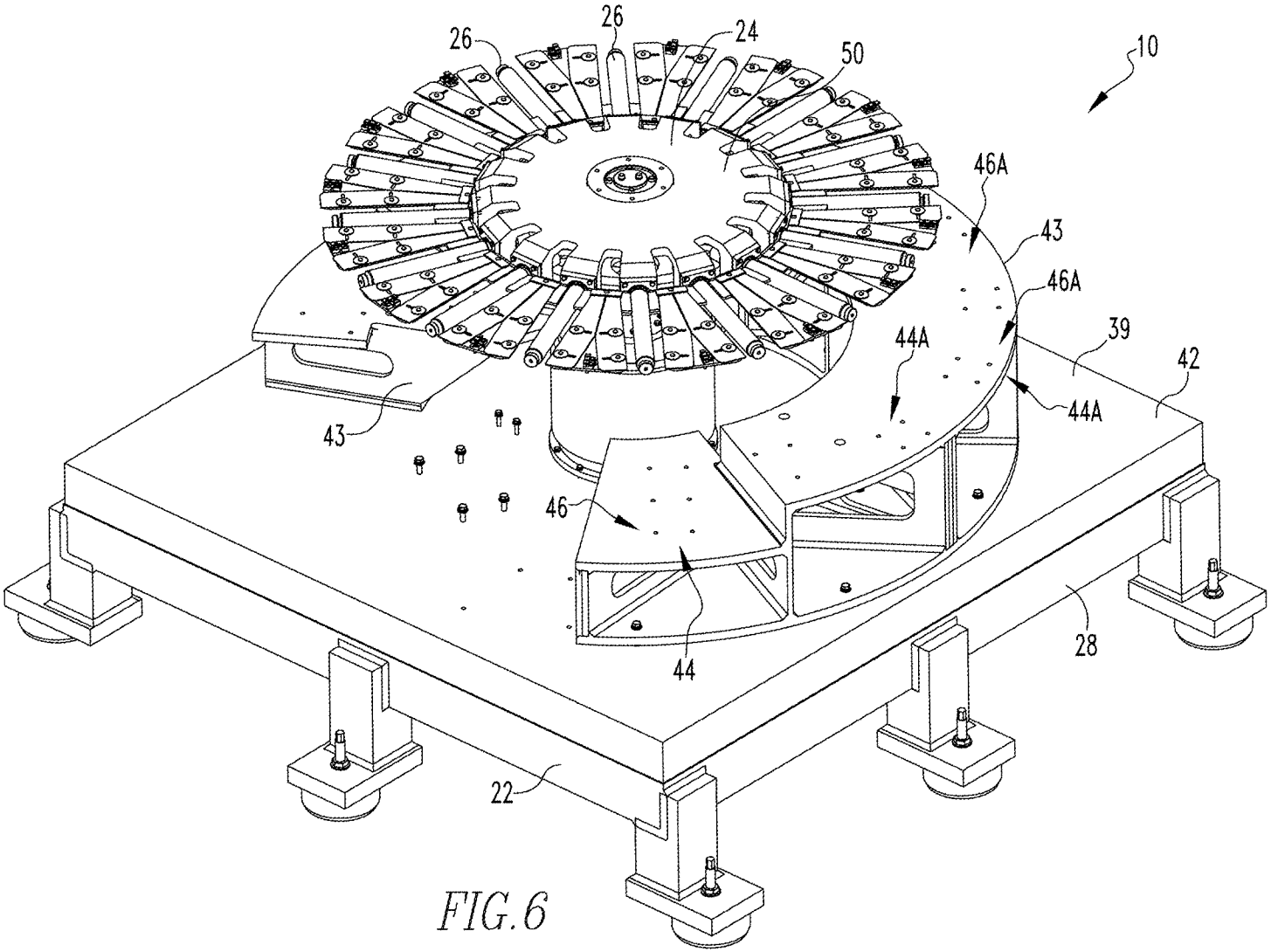
FIG. 6 is an isometric view of a decorator assembly with the ink stations and other stations removed.

As shown in FIGS. 4-6, the mandrel turret assembly turret 24, hereinafter "turret" 24, includes a hub 50. The turret hub 50 is structured to be rotatably coupled to the mandrel turret assembly housing assembly 22 and to rotate about a generally vertical axis. The turret axis of rotation 74 substantially corresponds to the turret drive assembly axis of rotation 74 and the same reference number shall collectively identify the "turret axis of rotation" 74, as used hereinafter. Details of the turret 24 are not relevant to the present disclosure; it is, however, noted that the turret 24 has a weight of between about 700 lbs. to 800 lbs., or about 750 lbs. The turret 24 weight is notable in that use of independent ink stations 100 allows the turret weight to be reduced relative to the prior art turret hubs 50. This is further notable because, in this configuration, the reduced weight relative to prior art turrets reduces the moment arm and other stresses on the mandrel turret assembly turret drive assembly 28 thereby solving the problems stated above.

The mandrel turret assembly mandrels 26, hereinafter "mandrels" 26, are substantially similar and only one will be described. As shown in FIG. 5, a mandrel 26 is an assembly that includes an elongated mandrel shaft (not shown), a hollow, elongated mandrel body 60, and a bearing assembly (not shown). In an exemplary embodiment, the mandrel body 60 is generally cylindrical. The elongated mandrel shaft has a longitudinal axis 61, a proximal end and a distal end (neither shown). The mandrel shaft may define one or more passages that are in fluid communication with a vacuum assembly and/or a pressurized air supply (none shown). As is known, a vacuum drawn through the mandrel 26 may be used to maintain a can body 1 in place during the can decoration operation and pressurized air may be used to remove the can body 1 from the mandrel 26. A mandrel proximal end 62 is structured to be coupled to the turret hub 50. The mandrel body 60, as noted, is a hollow, elongated body having a longitudinal axis which corresponds to the mandrel shaft longitudinal axis 61. The mandrel body 60 is structured to be coupled, directly coupled, or fixed to the mandrel shaft. In an exemplary embodiment, the mandrel body 60 is structured to be fixed to the mandrel shaft and rotate therewith. Thus, the mandrel body 60 is further structured to concentrically rotate about the mandrel shaft longitudinal axis 61. That is, the mandrel body 60 spins with the mandrel shaft. Each mandrel 26 is coupled to the turret hub 50 and extends generally radially relative to, and generally perpendicular to, the turret axis of rotation 74. Further, the mandrels 26 are substantially evenly spaced about the turret axis of rotation 74. That is, for example, if a turret 24 has six mandrels 26, the mandrels 26 are spaced about 60 degrees apart, whereas if a turret 24 has ten mandrels 26, the mandrels 26 are spaced about 36 degrees apart. In an exemplary embodiment, the turret 24 includes 16 mandrels 26 spaced about 22.5 degrees apart.

As shown in FIG. 5, the mandrel turret assembly turret drive assembly 28, hereinafter "turret drive assembly" 28, is structured to rotate the turret 24 relative to the mandrel turret assembly housing assembly 22. In an exemplary embodiment, the turret drive assembly 28 includes a motor 70 (shown schematically) with a rotating drive shaft 72. Further, in an exemplary embodiment, the turret drive assembly motor 70 is disposed in the mandrel turret assembly housing assembly enclosed space 40 and is coupled, directly coupled, removably coupled, or fixed to the mandrel turret assembly housing assembly 22. In an exemplary embodiment, the turret drive assembly drive shaft 72 extends generally vertically and has an axis of rotation 74 which, as noted above, substantially corresponds to the turret axis of rotation 74 and is collectively identified as the "turret axis of rotation" 74. In an exemplary embodiment, the mandrel turret assembly turret drive assembly 28 is structured to "index" the turret 24. That is, the mandrel turret assembly turret drive assembly 28 is structured to move the turret 24, i.e., rotate the turret 24 about the turret axis of rotation 74, intermittently with each movement covering a substantially similar arc.

The turret drive assembly drive shaft 72 includes a proximal, first end 80, a medial portion 82, and a distal, second end 84. The mandrel drive assembly drive shaft first end 80 is coupled, directly coupled, removably coupled or fixed to the turret drive assembly motor 70. The turret 24 is coupled, directly coupled, removably coupled or fixed to one of, or both, the mandrel drive assembly drive shaft medial portion 82 and/or mandrel drive assembly drive shaft second end 84.

Further, the use of independent ink stations 100 allows for the height of the turret 24 and the height of the turret drive assembly drive shaft 72 to be reduced relative to the prior art. That is, unlike the prior art wherein the turret drive assembly 28 is structured to drive the ink stations, and therefore include additional elements that require an extended height, the disclosed concept allows for a turret 24 with a reduced height relative to the turret drive assembly drive shaft 72. In an exemplary embodiment, the turret drive assembly drive shaft 72 has a first height, and, the turret 24 has a second height. The drive shaft 72 first height is between about 13.0 inches to 14.0 inches, or about 13.5 inches. The turret 24 second height is between about 4.0 inches to 5.0 inches, or about 4.5 inches. In this configuration, the moment arm and weight of the turret 24 is reduced relative to the prior art and therefore solves the problems stated above.

The mandrel turret assembly mandrel drive assembly 30, hereinafter "mandrel drive assembly" 30, is structured to rotate each mandrel body 60 and mandrel shaft about the associated mandrel shaft axis 61. Thus, each mandrel body 60 rotates about a generally horizontal axis. In an exemplary embodiment, the mandrel drive assembly 30 is operatively coupled to the mandrel turret assembly turret drive assembly 28. Thus, rotation of the turret 24 about the turret axis of rotation 74 causes each mandrel body 60 to rotate about a generally horizontal axis. In this configuration, the mandrels 26 move over a generally horizontal and circumferential path of travel. That is, as used herein, a "path of travel" includes the space an element moves through when in motion. Further, the mandrels "index" as described above. Thus, the mandrels 26 move intermittently in a circle about the turret axis of rotation 74 while each mandrel 26 also spins about its own longitudinal axis. The mandrel 26 path of travel moves each mandrel 26 through the mandrel turret assembly housing assembly bays 44. Further, each indexed stop, i.e., the intermittent stop in the mandrels 26 movement over the path of travel, occurs at each mandrel turret assembly housing assembly bay 44. Thus, each mandrel's 26 rotational motion about the turret axis of rotation 74 is halted at a cure station 34, an independent ink station 100, or other station as described below.

In an exemplary embodiment, the drive control assembly 32 and the number of ink cure stations 34 are optional elements of the mandrel turret assembly 20 and are discussed below.

Each independent ink station 100 is structured to be removably coupled to the mandrel turret assembly housing assembly 22 and disposed adjacent to the path of travel of the mandrels 26. A mandrel path of travel is shown schematically in FIG. 8. As used herein, "adjacent [a] path of travel" means next to, but not in the mandrel path of travel. As noted below, one embodiment includes a collar assembly 140 that moves into the mandrel path of travel; such an embodiment is also, as used herein, disposed "adjacent [a] path of travel." That is, as used herein, a collar assembly 140 that is disposed out of the mandrel path of travel when the mandrel turret assembly turret 24 is rotating, but moves over a mandrel 26 when the mandrel turret assembly turret 24 is stationary is, as used herein, disposed "adjacent the mandrel path of travel" Conversely, a construct, such as, but not limited to, a print roll or a blanket that is always disposed in a mandrel path of travel is not disposed "adjacent the mandrel path of travel" but is rather "in the mandrel path of travel," as used herein. Further, each independent ink station 100 is structured to apply ink to a can body 1 disposed on an adjacent mandrel 26, as described below. It is noted that one principle of operation of an independent ink station 100, as used herein, is that an independent ink station 100 is disposed adjacent a mandrel 26 path of travel. Conversely, it is noted that an ink station that uses a print roll requires that the print roll is disposed in the mandrel path of travel. That is, a principle of operation of an ink station that uses a print roll, or a blanket, is that the print roll/blanket be in the mandrel 26 path of travel. Thus, combining or substituting an ink station that uses a print roll with an independent ink station 100, or vice-versa, would change the principle of operation of both print devices.

Figure 7:
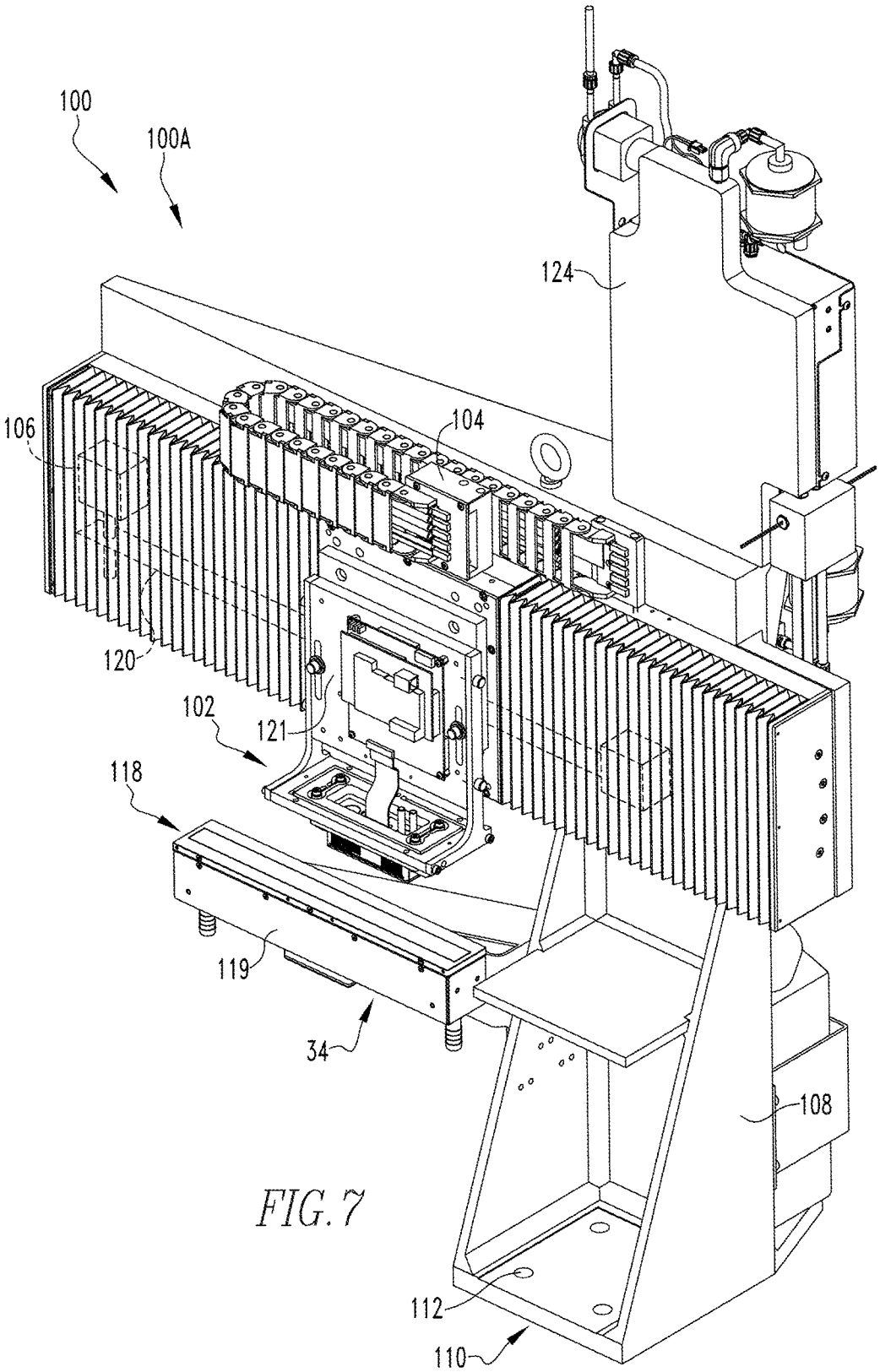
FIG. 7 is an isometric view of an independent ink station.
Figure 8:
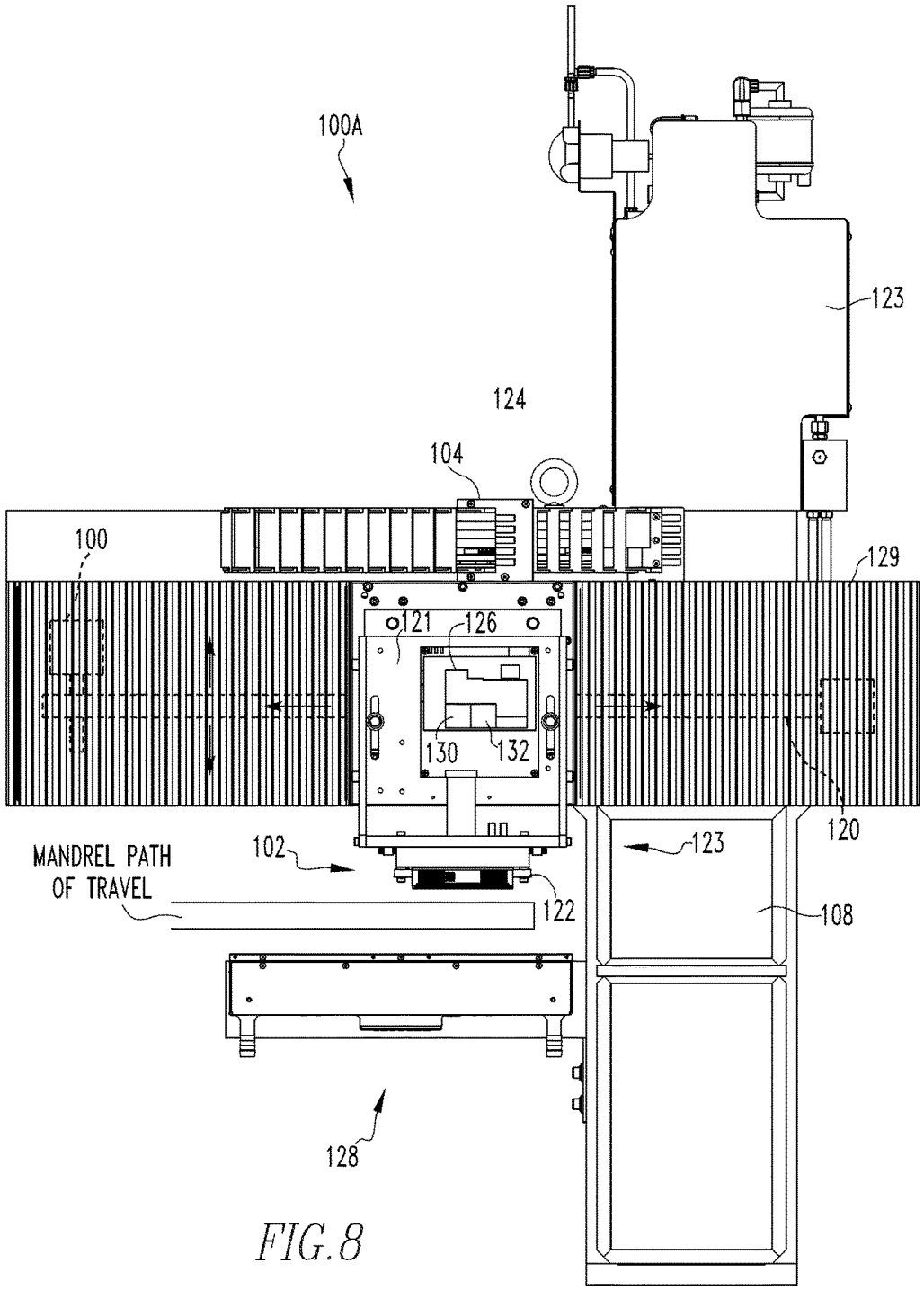
FIG. 8 is a front view of an independent ink station.

In an exemplary embodiment, as shown in FIGS. 7 and 8, the independent ink stations 100 are substantially similar and only one independent ink station 100 will be described. In an exemplary embodiment, an independent ink station 100 includes a number of digital print head assemblies 102, a number of print head drive assemblies 104, a number of print head radial positioning assemblies 106, and a support assembly 108, some elements shown schematically.

Each independent ink station 100, in an exemplary embodiment, is disposed adjacent to the mandrel 26 path of travel. As used herein, directional terms relating to an independent ink station 100 shall be discussed in relation to a mandrel's 26 longitudinal axis when the mandrel 26 is stopped adjacent to an independent ink station 100. In an exemplary embodiment, each independent ink station 100 includes a single digital print head assembly 102, shown in FIG. 7. Further, the single digital print head assembly 102 is structured to apply a single color of an indicia, i.e., an ink having a single color. Hereinafter, a digital print head assembly 102 structured to apply a single color ink is a "monochromatic digital print head assembly" 102A, shown in FIG. 8. That is, a "color ink" is applied to a portion of a final indicia that combines multiple colors.

As shown in FIG. 8, a digital print head assembly 102, or a monochromatic digital print head assembly 102A, is disposed above the mandrel 26 path of travel as well as above the generally horizontal axis of rotation of an adjacent mandrel 26. This is notable because, in this configuration, the ink is less likely to be sprayed onto broadly adjacent areas thereby solving the problems stated above. That is, spraying the ink downwardly solves the problems stated above.

Figure 9:
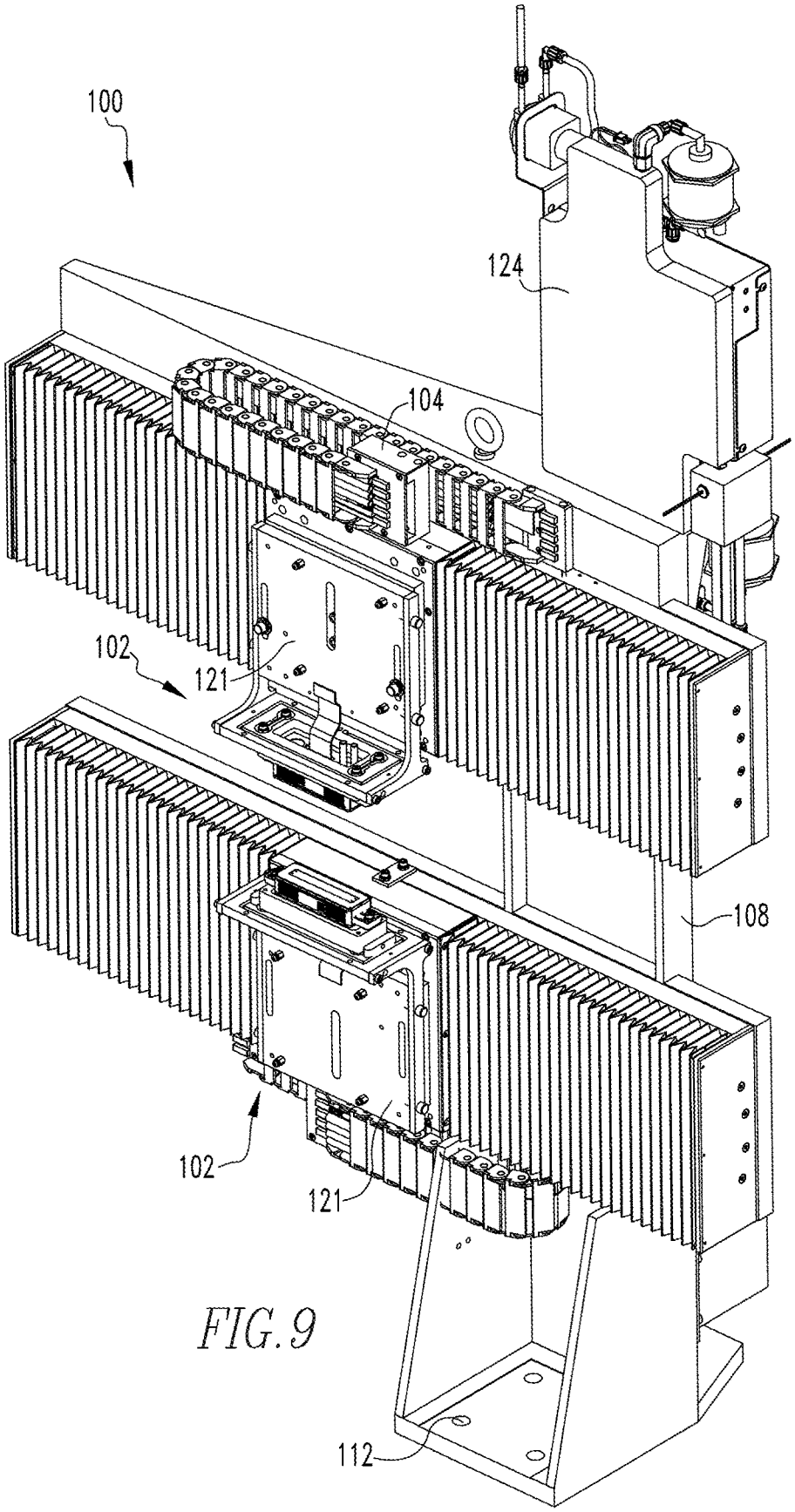
FIG. 9 is an isometric view of an alternate embodiment of the independent ink station.
Figure 10:
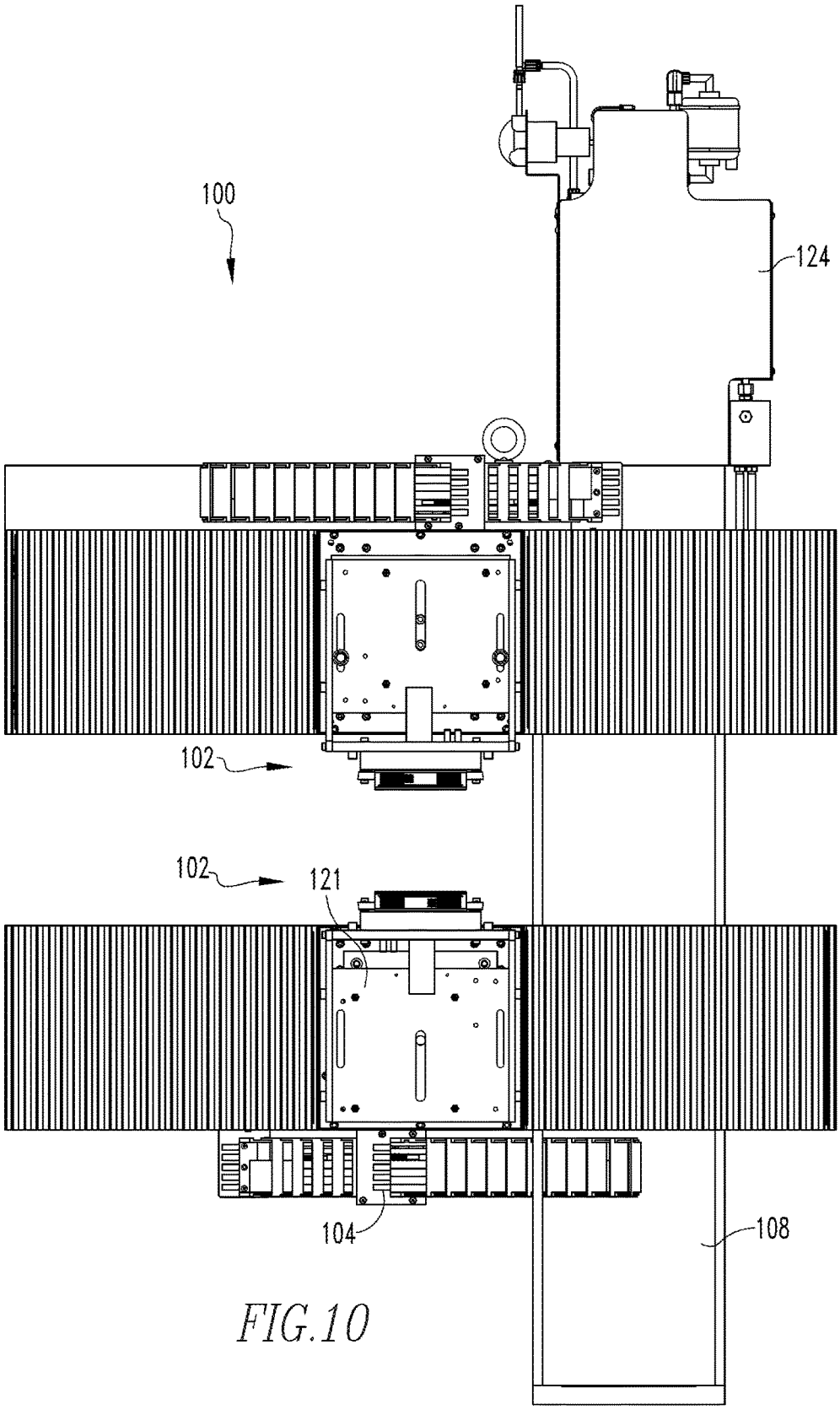
FIG. 10 is a front view of an alternate embodiment of the independent ink station.

In another embodiment, shown in FIGS. 9 and 10, there are a plurality of digital print head assemblies 102 (two shown) that are radially offset from an adjacent digital print head assembly in the same independent ink station 100 by between about 30 to 180 degrees. As shown, the two digital print head assemblies 102 are 180 degrees apart, i.e., about the mandrel's 26 longitudinal axis when the mandrel 26 is stopped adjacent to the independent ink station 100. In an embodiment with a plurality of digital print head assemblies 102 at an independent ink station 100, the digital print head assemblies 102 may be structured to apply the same color ink. Such an independent ink station 100 is hereinafter defined as a "monochromatic independent ink station" 100A.

As used herein a "digital print head assembly" 102 is a construct structured to apply ink, or a similar medium for creating an indicia, in a programmable pattern according to an electronic construct such as, but not limited to, a computer file. Hereinafter, "ink" includes any medium that can be used to create an indicia by applying the medium to a substrate. In an exemplary embodiment, the ink is an ultraviolet (UV) curable ink. Accordingly, in an exemplary embodiment, a digital print head assembly 102 includes a track 120 (shown schematically), a carriage 121, a print head 122, an ink reservoir 123, a processing assembly 124, a computer readable medium 126, and a number of modules 128 (FIG. 8). As shown, the track 120 and a portion of the carriage 121 are protected by a barrier such as, but not limited to, a bellows 129.

A "track" 120 as used herein, is any elongated construct, or articulated assembly, that defines, or partially defines, the path of travel of the print head 122. In an exemplary embodiment, the carriage 121 supports the print head 122, and, the carriage 121 travels over the track 120. In this embodiment, the track 120 extends generally horizontal. The print head 122, the processing assembly 124, and the computer readable medium 126 are in electronic communication with each other. The print head 122 is structured to transport ink from a reservoir (not shown) and apply the ink to a substrate. In an exemplary embodiment, the print head 122 is structured to apply ink in a specific direction, as used herein, the "spray direction." The print head 122 is configured so that the spray direction is generally toward the longitudinal axis when a mandrel 26 is stopped adjacent to an independent ink station 100. That is, in an exemplary embodiment, the spray direction is generally radial to the mandrel longitudinal axis 61 when a mandrel 26 is stopped adjacent to an independent ink station 100.

As shown in FIG. 8, the number of modules 128 are stored on the computer readable medium 126 and include an instruction module 130, structured to control the print head 122, as well as a number of design modules 132. That is, the design modules 132 include data representing patterns or other designs according to which the ink is applied. The instruction module 130 controls the position of the print head relative to the substrate. The processing assembly 124 processes and/or executes the instructions of the instruction module 130 according to the pattern associated with a design module 132. In one embodiment, not shown, the processing assembly 124 is part of a full computer that is remote to the mandrel turret assembly 20. In an exemplary embodiment, the digital print head assembly 102 is an ink jet assembly 125.

In one embodiment, the design module 132 is selectable. That is, each time a can body 1 is about to have ink applied, the digital print head assembly 102 reads, i.e., the processing assembly 124 executes the instruction module 130 and downloads data from, a design module 132 and applies an ink according to the pattern associated with that design module 132. Thus, the indicia applied to different can bodies 1 is different. In another embodiment, the digital print head assembly 102 stores, i.e., the instruction module 130 utilizes, a single design module 132 for a period of time. In this embodiment, the indicia applied to each can body 1 in a series of cans is substantially the same.

Each print head drive assembly 104 is operatively coupled to an associated digital print head assembly 102 and structured to move the associated digital print head assembly 102 longitudinally relative to a mandrel's 26 longitudinal axis when the mandrel 26 is stopped adjacent to the independent ink station 100. Stated alternately, the digital print head assembly 102 path of travel extends generally parallel to the mandrel axis of rotation 61 and generally radially relative to the turret axis of rotation 74. In an exemplary embodiment, a print head drive assembly 104 is structured to move the associated digital print head assembly 102 between about 3.0 inches and 13.0 inches longitudinally. That is, each print head drive assembly 104 is structured to move an associated digital print head assembly 102 between a longitudinal first position and a longitudinal second position.

In an exemplary embodiment, each digital print head assembly 102 further includes a cure assembly 118. A digital print head assembly cure assembly 118 in an embodiment that utilizes UV ink, includes a UV assembly 119 structured to provide a UV light. In an exemplary embodiment, the UV assembly 119 is disposed generally opposite, i.e., on the other side of the longitudinal axis of a mandrel 26 when the mandrel 26 is stopped adjacent to an independent ink station 100. The UV assembly 119 is structured to be active, i.e., shine the UV light, when a mandrel 26 is stopped adjacent to an independent ink station 100. In an exemplary embodiment, the cure assembly 118 is structured to partially cure the ink. That is, for example, the UV assembly 119 is structured to be active for a period of time insufficient to fully cure the ink.

In an embodiment wherein there are a plurality of digital print head assemblies 102 in a single independent ink station 100, each digital print head assembly 102 has an associated print head drive assembly 104. Further, in this embodiment, each digital print head assembly 102 can be structured to apply ink to a selected portion of the can body 1. That is, for example, a first digital print head assembly 102 may apply ink to the top half of the can body 1 while a second digital print head assembly 102 applies ink to the bottom half of the can body 1. Stated alternately, each print head drive assembly 104 is structured to move an associated digital print head assembly 102 over a different longitudinal portion of an adjacent mandrel 26. Further, in an exemplary embodiment, the different longitudinal portions of the adjacent mandrel over which the digital print head assembly 102 pass do not substantially overlap.

Each print head radial positioning assembly 106 is operatively coupled to an associated digital print head assembly 102 and structured to move the associated digital print head assembly 102 radially relative to a mandrel's 26 longitudinal axis when the mandrel 26 is stopped adjacent to the independent ink station 100. That is, as is known, the mandrel body 60 disposed on a mandrel shaft may be replaced with a mandrel body 60 having a different radius. That is, the mandrel body 60 is structured to support can bodies 1 having a specific radius and, if the decorator assembly 10 needs to decorate cans 1 having a different radius, the mandrel bodies 60 are swapped out. Further, to allow for the application of ink to cans 1 having a different radius, each digital print head assembly 102 is structured to move radially relative to a mandrel longitudinal axis 61 when the mandrel 26 is stopped adjacent to the independent ink station 100. In an exemplary embodiment, the print head radial positioning assembly 106 is operatively coupled to an associated digital print head assembly 102 and is structured to move the associated print head assembly 102 between a radial first position and a radial second position.

In an exemplary embodiment, the independent ink station support assembly 108 is an elongated assembly extending generally vertically. The independent ink station support assembly 108 is structured to support the track 120. That is, as noted above. the track 120, and therefore the digital print head assembly 102, extend generally horizontally from the independent ink station support assembly 108. In this configuration, the digital print head assembly 102 is disposed in a "cantilever configuration." As used herein, a "cantilever configuration" means a projecting beam or member supported at only one end. It is noted that, in a "cantilever configuration" the digital print head assembly 102 has a lower weight than a traditional design. This is notable because, in this configuration, the reduced weight solves the problems stated above.

The independent ink station support assembly 108, in an exemplary embodiment, includes easy to access coupling components 110. For example, as shown in FIG. 9, the independent ink station support assembly 108 includes a number of passages 112 disposed in a pattern corresponding to the bay passages 46, discussed above. Thus, the independent ink station support assembly 108, and therefore the independent ink station 100, can be easily coupled, directly coupled or removably coupled to the mandrel turret assembly housing assembly 22 by passing fasteners 114 (FIG. 1) through the support assembly passages 112 and the bay passages 46. It is further noted that, in this configuration, the turret drive assembly 28 and each said print head drive assembly 104 are not operatively coupled. This configuration further allows for the independent ink station 100 to be removably coupled to the mandrel turret assembly housing assembly 22 and solves the problems stated above. That is, the independent ink station support assembly 108 is removably coupled to the frame assembly 43 at a bay 44 or a uniform bay 44A.

Figure 11:
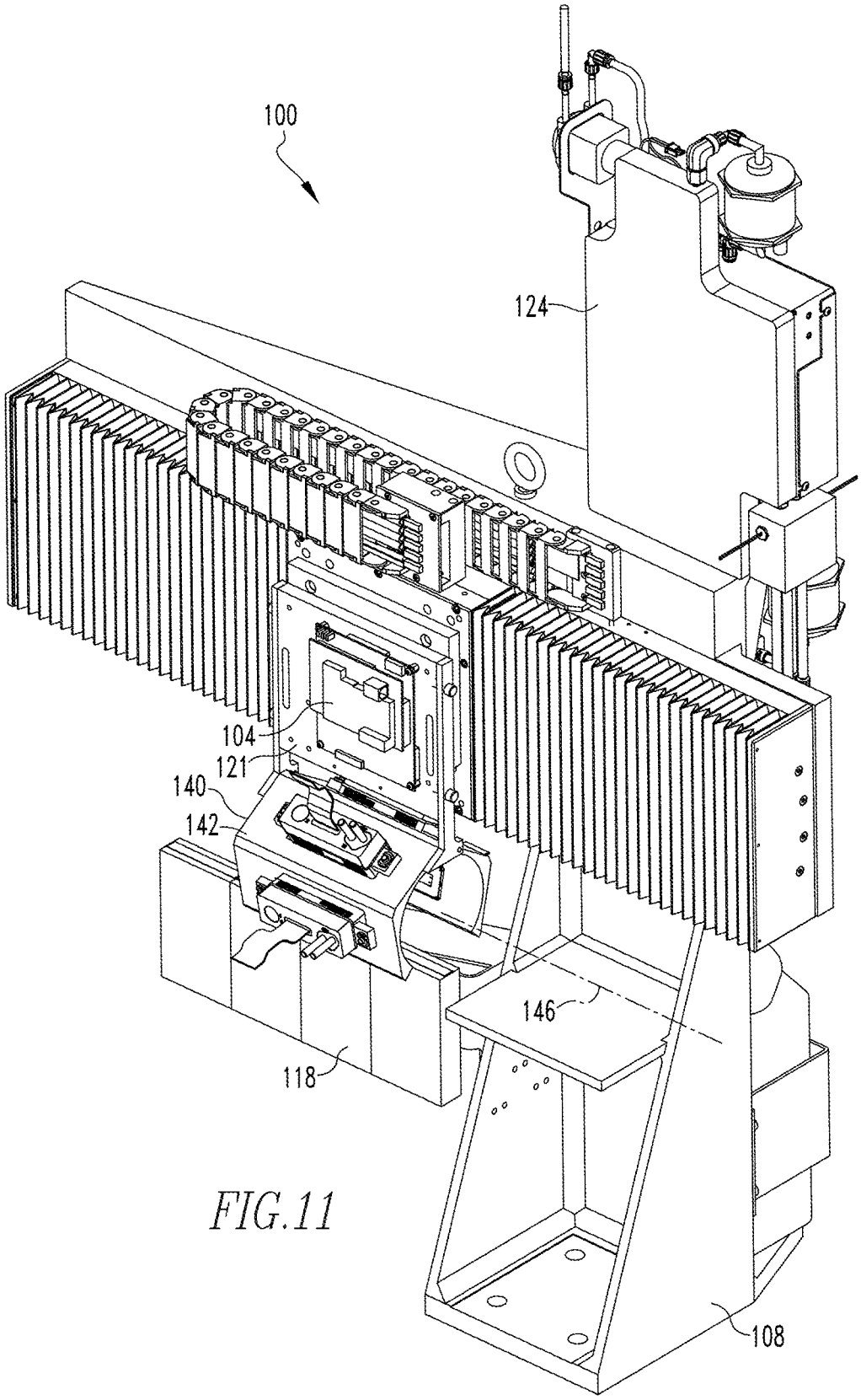
FIG. 11 is an isometric view of another alternate embodiment of the independent ink station.
Figure 12:
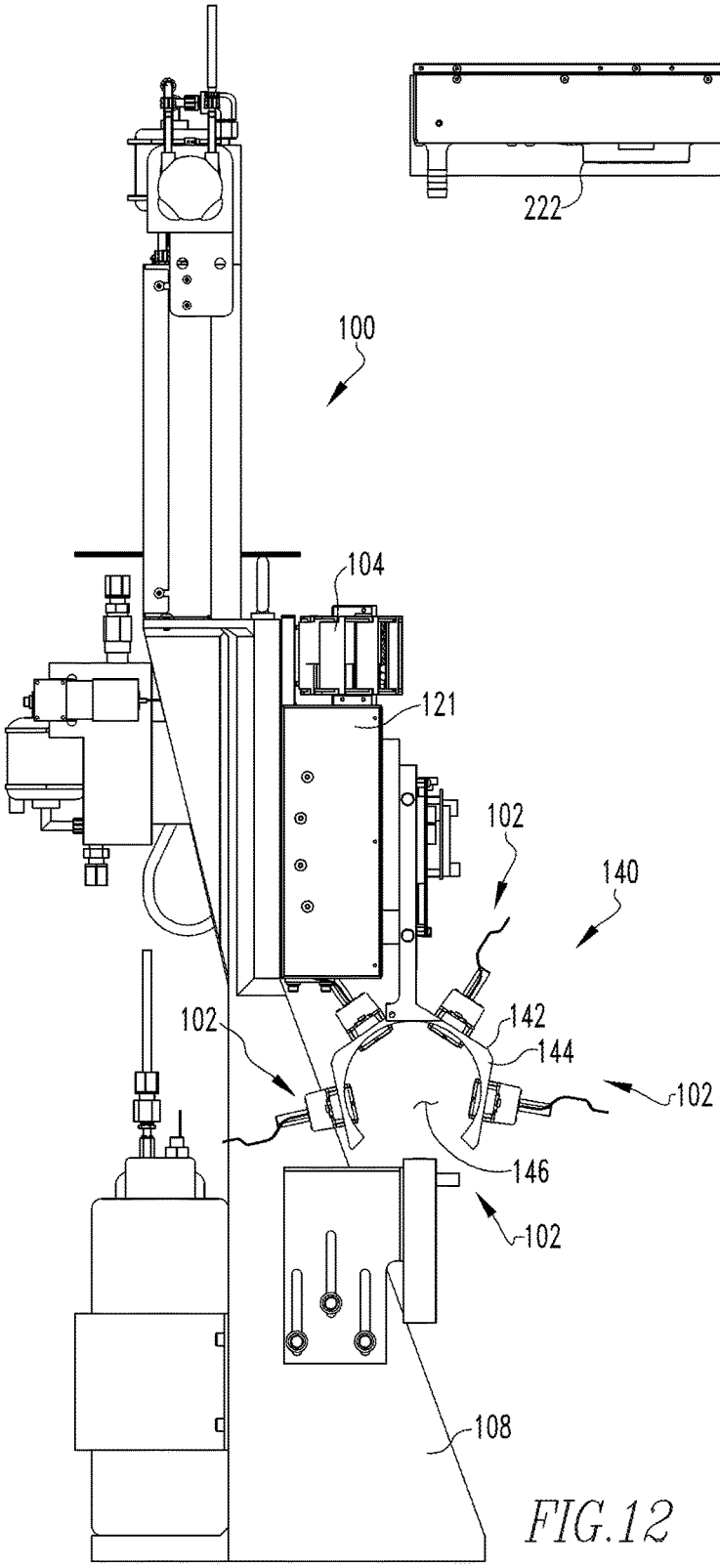
FIG. 12 is a side view of another alternate embodiment of the independent ink station.

In an alternate embodiment, shown in FIGS. 11 and 12, each independent ink station 100 includes a collar assembly 140. A collar assembly 140 includes a collar element 142 and a number of digital print head assemblies 102 and a single print head drive assembly 104. In an exemplary embodiment, the collar assembly 140 includes a plurality of print head assemblies 102. The collar element 142 is a hollow generally cylindrical body 144 including a center axis 146. The collar element body 144 inner radius is larger than the outer radius of a mandrel body 60. The collar element 142 supports the plurality of print head assemblies 102 with each print head 122 having a spray direction generally radial to the mandrel longitudinal axis 61 when a mandrel 26 is stopped adjacent to an independent ink station 100.

In this embodiment, the print head drive assembly 104 is structured to move the collar element 142 from a first position, wherein the collar element 142 is positioned outward (i.e., radially away from the turret axis of rotation 74) from the mandrel 26 path of travel and a second position, wherein the collar element 142 is positioned about the mandrel 26 that is stopped adjacent to an independent ink station 100. In this configuration, and as the collar element 142 moves between the first and second position, the collar element 142 passes over a can body 1 disposed on a mandrel 26 that is stopped adjacent to an independent ink station 100. The portion of the collar element 142 path of travel that extends over a can 1 disposed on a mandrel 26 that is stopped adjacent to an independent ink station 100 is, as used herein, the "application portion" of the collar element 142 path of travel. As the collar element 142 moves over the application portion, each digital print head 122 applies an ink to the can body 1. The digital print head assemblies 102 may apply the ink one at a time or simultaneously.

In an exemplary embodiment, the mandrel turret assembly 20 includes a drive control assembly 32. The mandrel turret assembly drive control assembly 32, hereinafter "drive control assembly" 32, is structured to independently, and electronically actuate the turret drive assembly 28, mandrel drive assembly 30 and each print head drive assembly 104. That is, the drive control assembly 32 does not operably couple these drive assemblies, 28, 30, 104, but is structured to provide timed instructions whereby the drive assemblies, 28, 30, 104 are actuated in a desired sequence. The drive control assembly 32 includes a processing assembly, a computer readable medium, and a number of modules such as a control module, none shown. It is understood that these physical elements are in electronic communication with each other as well as with the drive assemblies, 28, 30, 104.

Figure 13:
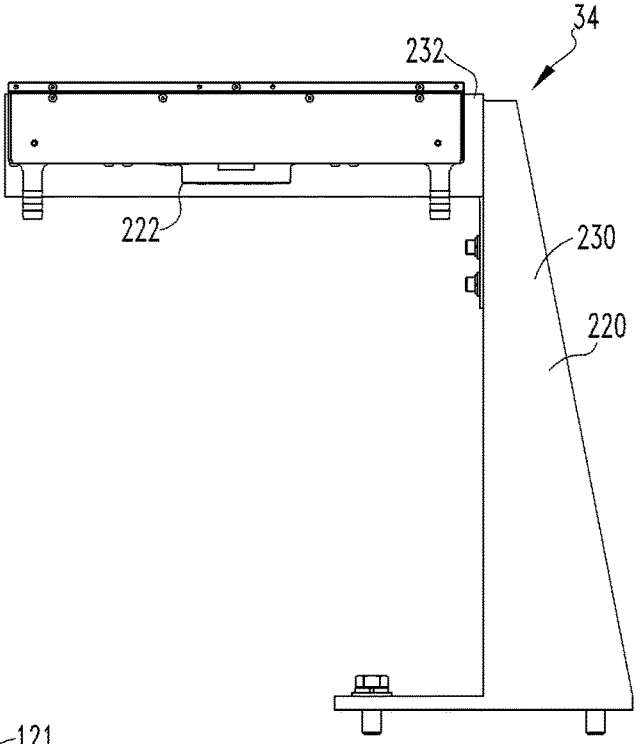
FIG. 13 is a side view of an ink cure station.

Further, in an exemplary embodiment, the mandrel turret assembly 20 includes a number of ink cure stations 34. The mandrel turret assembly ink cure stations 34, hereinafter "cure stations" 34, are substantially similar and only one will be described. Thus, in an exemplary embodiment, an ink cure station 34, shown in FIG. 13, includes a support assembly 220 and an ultraviolet cure assembly 222. The ink cure station support assembly 220 includes a vertical member 230 and a horizontal member 232. The ink cure station support assembly vertical member 230 is structured to be removably coupled to a mandrel turret assembly housing assembly bay 44. That is, an ink cure station support assembly vertical member 230 is configured in a manner substantially similar to the independent ink station support assembly 108. The ink cure station support assembly horizontal member 232 extends generally horizontally from an associated ink cure station support assembly vertical member 230. That is, each ink cure station support assembly horizontal member 232 extends in a cantilever manner adjacent a mandrel 26 path of travel. In an alternative embodiment, not shown, an ink cure station 34 is coupled, directly coupled, removably coupled or fixed to an independent ink station support assembly 108.

In an exemplary embodiment, the independent ink stations 100 and the ink cure stations 34 are each disposed in a mandrel turret assembly housing assembly bay 44 or uniform bay 44A. In one exemplary embodiment, there is a single ink cure station 34 disposed downstream of all independent ink stations 100. In another embodiment, an ink cure station 34 is disposed immediately downstream of each independent ink station 100. In another embodiment, at least one independent ink station 100 is disposed in a mandrel turret assembly housing assembly bay 44 upstream of at least one ink cure station 34.

Figure 14:
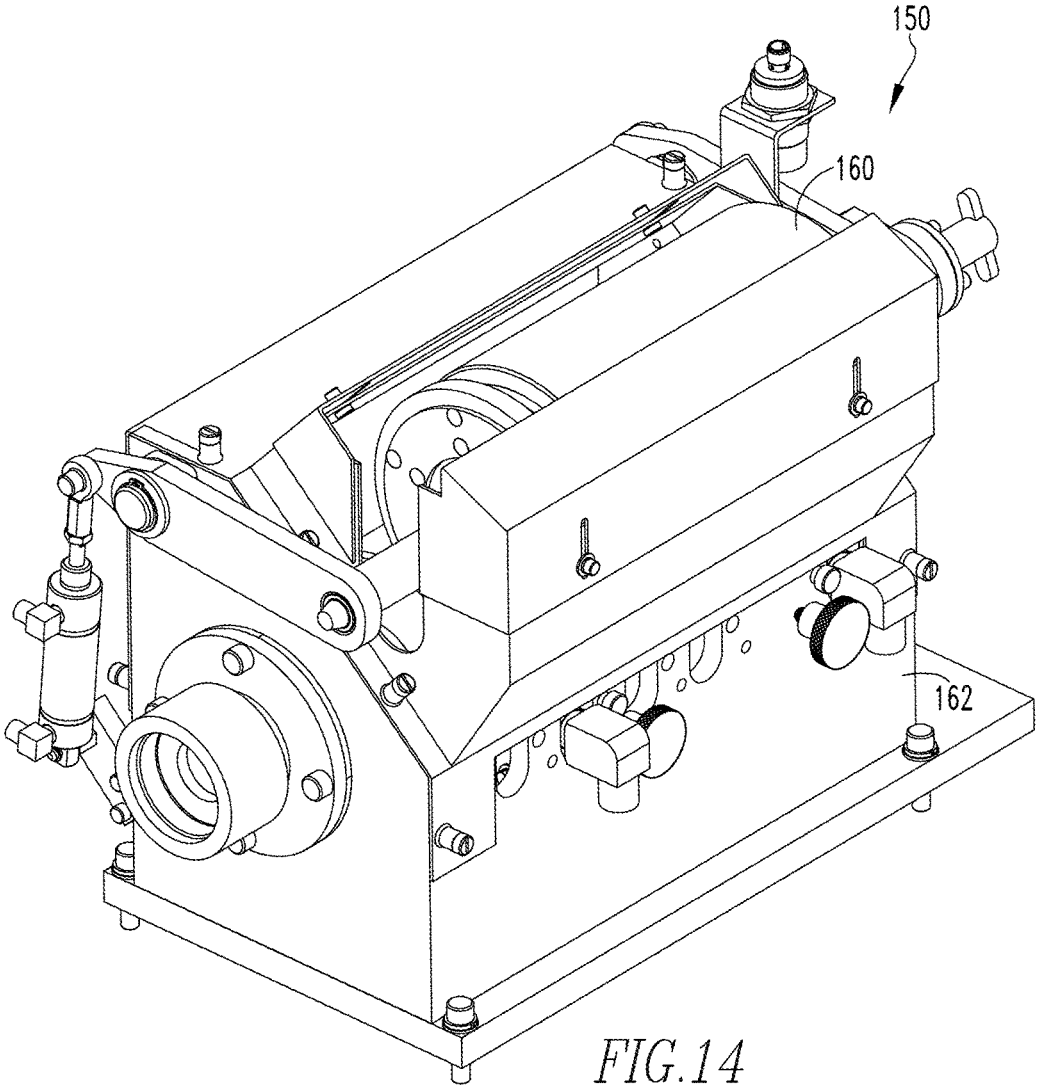
FIG. 14 is an isometric view of a varnish station.

In an exemplary embodiment, the mandrel turret assembly 20 also includes a number of varnish stations 150 and number of varnish cure stations 152. Each varnish station 150 is structured to apply varnish to a can body 1 on a mandrel 26. The varnish may be a base coat varnish or an overcoat varnish. A base coat varnish is applied to a can body 1 before the ink. An overcoat varnish is applied to a can body 1 after the ink. Each varnish station 150, shown in FIG. 14, includes a varnish applicator 160, and a support assembly 162. Each varnish station 150 is structured to be removably coupled to a mandrel turret assembly housing assembly bay 44.

Each varnish cure station 152 is substantially similar to an ink cure stations 34, but is structured to cure a varnish. That is, each varnish cure station 152 includes a vertical member and a horizontal member wherein the horizontal member extends over the mandrel 26 path of travel. It is noted that each varnish cure station 152 is structured to be removably coupled to a mandrel turret assembly housing assembly bay 44.

Figure 15:
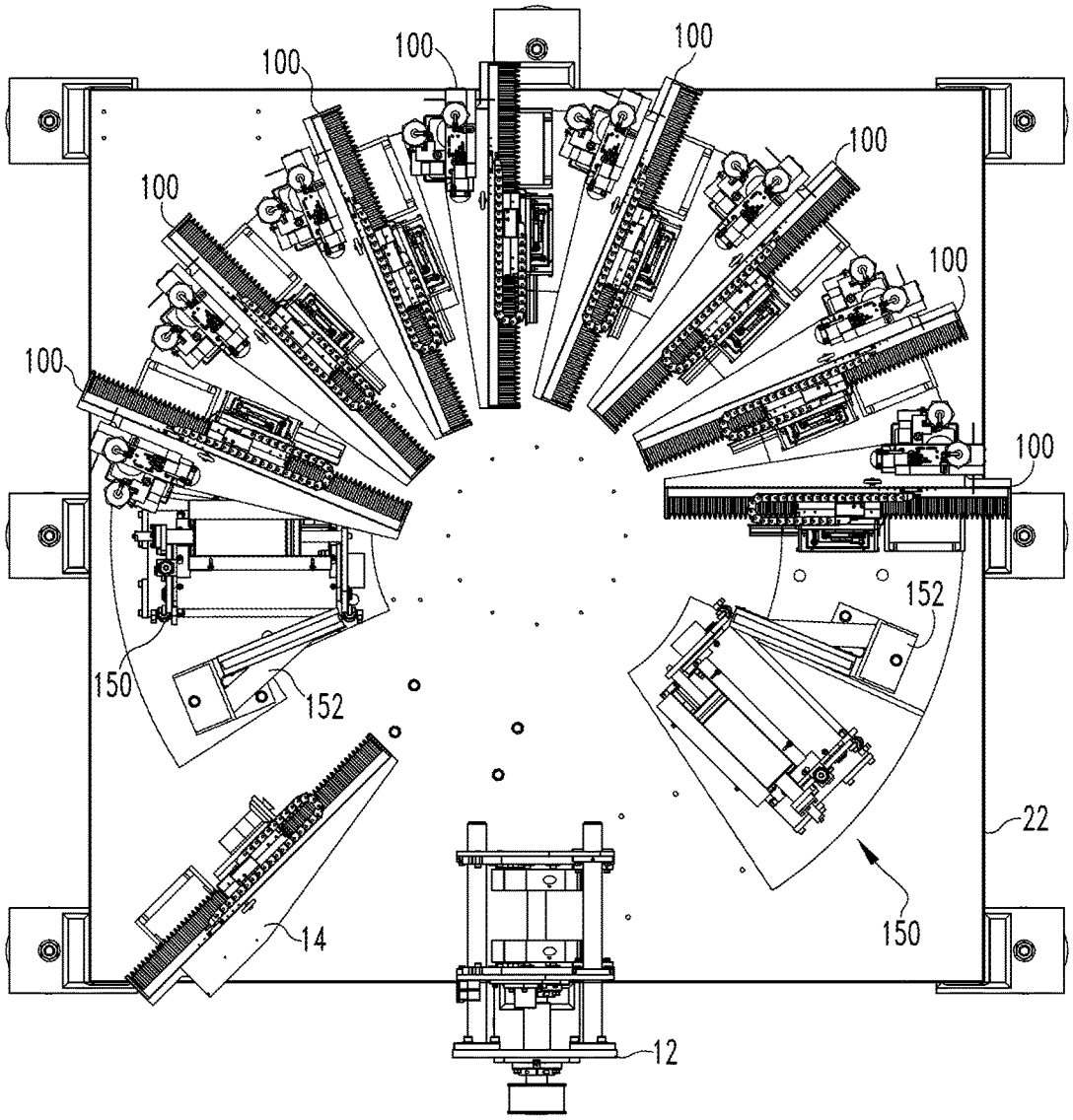
FIG. 15 is a top view of a decorator assembly with the turret removed.

In an exemplary embodiment, shown in FIG. 15, the mandrel turret assembly housing assembly 22 includes eight uniform bays 44A and five non-uniform bays 44. In an exemplary embodiment, the following components are removably coupled to the mandrel turret assembly housing assembly bays 44, in order from the first, most upstream bay 44, to the last, downstream bay 44: an in-feed assembly 12, a base coat, first varnish station 150, a varnish cure station 152, eight sequential independent ink stations 100, an overcoat, second varnish station 150, a varnish cure station 152 and an ejection assembly 14. In this embodiment, the independent ink stations 100 are disposed in the uniform bays 44A. Further, in this exemplary embodiment, a number of digital print head assemblies 102 further includes a cure assembly 118. As noted above, in another embodiment (not shown) ink cure stations 34 can be independent stations occupying a bay 44 or uniform bay 44A.

As the turret 24 rotates, each mandrel 26 indexes, i.e., moves intermittently, into each bay 44 and adjacent one of the in-feed assembly 12, a varnish station 150, an independent ink station 100, an ink cure station 34, a varnish cure station 152, or the ejection assembly 14. At each bay 44, the associated station 12, 150, 100, 34, 152, 14 performs its designated operation whereby a can body 1 has an indicia applied thereto.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A decorator assembly comprising:

a number of mandrels and a number of independent ink stations;

each mandrel structured to rotate about a longitudinal axis;

said mandrels' longitudinal axes disposed generally in a plane;

each said independent ink station disposed adjacent to the path of travel of said mandrels;

each independent ink station includes a number of digital print head assemblies; and wherein each independent ink station includes a collar assembly.

2. The decorator assembly of claim 1 wherein a number of said ink cure stations include an ultraviolet cure assembly.

3. The decorator assembly of claim 1 wherein:

each independent ink station includes a number of print head drive assemblies;

each said print head drive assembly operatively coupled to an associated digital print head assembly and structured to move said associated digital print head assembly between a longitudinal first position and a longitudinal second position; and wherein each said digital print head assembly path of travel extends generally parallel to the axis of rotation of an adjacent mandrel.

4. The decorator assembly of claim 3 wherein:

each independent ink station includes a number of print head radial positioning assemblies; and each said print head radial positioning assembly operatively coupled to an associated digital print head assembly and structured to move said associated print head assembly between a radial first position and a radial second position.

5. The decorator assembly of claim 1 wherein each digital print head assembly is disposed in a cantilever configuration.

6. The decorator assembly of claim 1 wherein:

each said independent ink station includes a track, a carriage and a print head;

each said carriage traveling over an associated track; and each said carriage supporting an associated print head.

7. The decorator assembly of claim 6 wherein said decorator assembly is structured to apply ink to a can body, and wherein:

each digital print head assembly includes a number of modules;

said number of modules includes a number of design modules;

each design module having an associated pattern; and wherein the digital print head assembly reads a design module and applies an ink according to the pattern associated with that design module.

8. A decorator assembly comprising:

a number of mandrels and a number of independent ink stations;

each mandrel structured to rotate about a longitudinal axis;

said mandrels' longitudinal axes disposed generally in a plane;

each said independent ink station disposed adjacent to the path of travel of said mandrels;

each independent ink station includes a number of digital print head assemblies;

wherein each independent ink station includes a collar assembly;

said mandrels have a path of travel;

each collar assembly includes a collar element and a print head drive assembly;

each collar element includes a hollow, generally cylindrical body including a center axis;

wherein each collar element body inner radius is larger than the outer radius of a mandrel; and said print head drive assembly structured to move said collar element from a first position, wherein said collar element is positioned outward from said mandrel path of travel and a second position, wherein said collar element is positioned about said mandrel that is stopped adjacent to an independent ink station.

9. The decorator assembly of claim 8 wherein each collar assembly includes said number of said digital print head assemblies.

10. The decorator assembly of claim 9 wherein each print head assembly has a spray direction that is generally radial to a mandrel longitudinal axis when a mandrel is stopped adjacent to an independent ink station.

* * * * *